United States Patent [19]

Franek et al.

[11] 4,246,770

[45] Jan. 27, 1981

[54] APPARATUS FOR OPERATING ON HOLLOW WORKPIECES

[75] Inventors: Jozef T. Franek, Chorleywood; Paul Porucznik, St. Albans, both of England

[73] Assignee: Metal Box Limited, Reading, England

[21] Appl. No.: 47,738

[22] Filed: Jun. 12, 1979

[51] Int. Cl.[3] ..... B21D 17/04

[52] U.S. Cl. ..... 72/92; 72/94

[58] Field of Search ..... 72/92, 94, 110; 113/120 M, 120 W, 120 AA

[56] References Cited

U.S. PATENT DOCUMENTS

| | | | |
|---|---|---|---|
| 1,590,333 | 6/1926 | Tevander | 72/94 |
| 3,490,404 | 1/1970 | Vanderlaan et al. | 72/94 |

*Primary Examiner*—Lowell A. Larson

*Attorney, Agent, or Firm*—Diller, Ramik & Wight

[57] ABSTRACT

In a rotary turret-type machine, in which operations are performed on successive can body cylinders (8) or the like by a mandrel (159) inside the workpiece co-operating with a beading rail (176), each workpiece is guided smoothly into a cradle (151) which so supports and locates it throughout its stay in the machine that axial movement of the mandrel is unnecessary. Each cradle is reciprocated towards and away from the mandrel by a fixed cam (145). Each cradle has a spring loaded support roller permitting eccentric support of the can body during beading. Each mandrel preferably has a quick-acting coupling (200) permitting temporary radial displacement of the mandrel without loss of parallelism to accommodate a can body side seam. This coupling consists of a spring mounted support plate (305) engaging a register plate (304) through three balls (306) mounted in seats (307) in the rings to give radially-yielding tripod support.

15 Claims, 21 Drawing Figures

FIG. 1
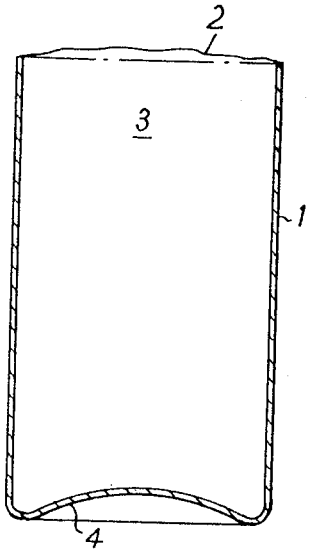
FIG. 2
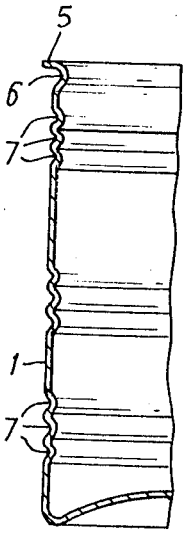
FIG. 3
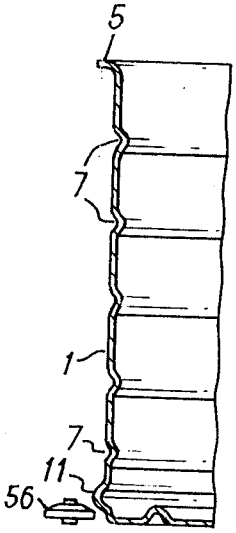
FIG. 4
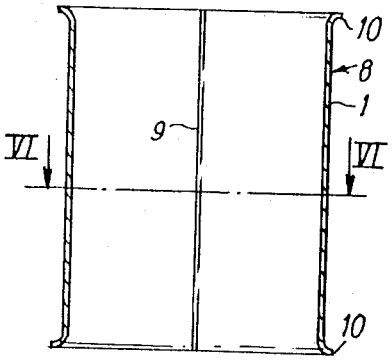
FIG. 5
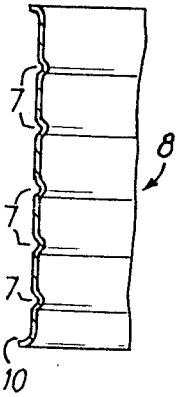
FIG. 13
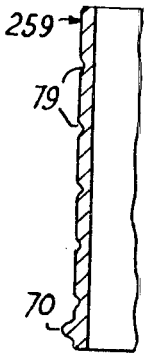
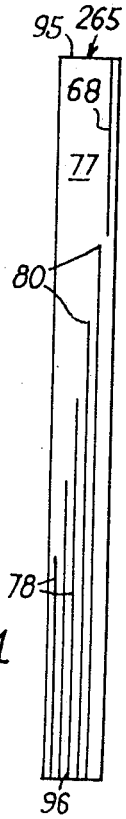
FIG. 14
FIG. 6
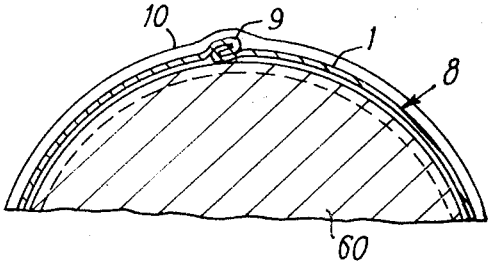

APPARATUS FOR OPERATING ON HOLLOW WORKPIECES

This invention relates to apparatus for performing an operation on a succession of thin-walled hollow workpieces, for example metal can bodies, the operation being for example that of beading, i.e. the formation of circumferential beads in the walls of the can bodies, and the apparatus thus for example being a beading machine.

The particular kind of apparatus to which the invention relates comprises a fixed machine frame; a turret rotatable about its own axis in said frame; a plurality of holding means carried by the main turret and spaced apart on a common pitch circle for holding a plurality of said workpieces; a feed station for feeding successive workpieces to the holding means; a discharge station, spaced circumferentially from the feed station with respect to the turret axis for removing successive workpieces from the holding means; means on the turret for carrying a male tool element for engagement within a said workpiece; means for carrying a further tool element for external engagement with a said workpiece in co-operation with the male tool element whereby to perform said operation on each workpiece in succession whilst the workpiece is held by the holding means between the feed station and the discharge station; and the apparatus further comprising placing means carried by the main turret, for effecting relative movement, longitudinally of the turret and in synchronism with rotation thereof, as between each holding means in succession and said male tool element, so as to put each workpiece and the tool elements into, and to take them out of, their relative dispositions for said operation. Such an apparatus will be referred to herein as an "apparatus of the kind hereinbefore specified".

Apparatus of the said kind is described in British patent specification No. 1509905, in which the apparatus concerned is a multi-head, turret-type, horizontal redraw press for forming one-piece metal can bodies by deep drawing cup-shaped workpieces previously formed in an initial drawing operation. In that particular case the male tool elements are draw press rams, the further tool elements, externally of the workpieces, being draw dies.

In the production of metal can bodies, there has of late been a considerable increase in the speed of output, due to the introduction of improved machinery and techniques. Thus, whereas a few years ago a can body manufacturing line could be expected, when working at full output, to produce bodies at a rate of the order of 400 to 600 per minute, modern equipment can make them at considerably higher speeds so that a production rate of around 800 can bodies per minute is now a reality. This is particularly true for one-piece can bodies, i.e. those destined to make two-piece cans when filled and then closed with a can end member. One-piece bodies are made by methods in which a flat metal blank is deep drawn to form a cup which is then elongated by subsequent steps consisting of further deep drawing (as for example in the press described in the aforementioned British patent specification No. 1509905), or wall ironing, or a combination of both. These methods lend themselves particularly to very high-speed operation.

However, the general trend towards faster speeds of production is also evident in respect of bodies for three-piece cans, in which the body consists of a body cylinder having a bottom end member secured at one end. The body cylinder for a three-piece can is formed by bending over a sheet of metal and joining its opposite edges to form a side seam running longitudinally down the side of the cylinder. This side seam may be formed in any one of a number of ways; but however it is formed it does produce a local thickening of the body wall along the line of the seam, and this is significant to certain aspects of the present invention, as will be seen later herein. Except where specified otherwise, the term can body is sometimes used hereinafter as a generic term for can bodies for two-piece cans and body cylinders for three-piece cans.

One result of increased production speeds is that it is necessary for ancillary equipment to be either modified so as to increase the throughput of can bodies or cylinders therethrough, or duplicated so that the greater throughput can be accommodated by splitting the manufacturing line before or after the bodymaking machinery (or both), so as to provide two or more branches operating in parallel. This latter arrangement is undesirable for a number of reasons, such as first cost; additional use of space; increased maintenance requirements; and so on. It is preferable to develop the ancillary equipment so that it is capable of handling can bodies at whatever maximum output the body-making machine is capable of giving.

Ancillary equipment includes that for feeding stock to the bodymaker and removing the can bodies or body cylinders therefrom; trimming machines for trimming the raw open ends of one-piece can bodies; and flanging machines for making a flange at the trimmed open end, or (in the case of can body cylinders for three-piece cans) for flanging both of the ends. It may also include machines for forming a neck immediately adjacent the end flange or each end flange (such machines may be arranged) to form a neck and flange simultaneously); and beading machines. Beading is a necessary operation where the wall thickness of the can body is such that a plain cylindrical wall requires strengthening. Beading has long been employed for three-piece food cans of the larger sizes, but is now becoming increasingly desirable for other cans, in view of the trend towards thinner and thinner side walls. This latter trend has become apparent as a result of the development of wall ironing and redrawing techniques for one-piece can bodies, which enable side walls to be produced to considerably reduced thicknesses as compared with those necessary for three-piece cans. However, increased use of so-called "double reduced" tinplate for the latter renders strengthening of the sidewall by beading desirable for body cylinders for three-piece cans in more instances than was previously the case.

There is thus a requirement for a beading machine which is capable of handling can bodies or body clinders the length of which may be the greatest likely to be encountered in a metal can, and which is also capable of very high speed operation, i.e. of operating at speeds substantially higher than those required in such machines hitherto, which, because they have tended to be required only on the larger sizes of can, or on other sizes under only some circumstances, have generally not been called upon to perform at particularly high speed. The requirement for very high-speed operation is lent some further importance by the fact that, due to the trend towards reduced wall thickness, the beading machine is likely to represent an additional item in manufacturing lines where formerly it would have been absent. If a beading machine can therefore be made so that it has, say, twice the output of a modern high-speed bodymaker, then two of the latter can feed a single bending machine, thus reducing for each line the additional capital cost, maintenance requirement etc. concomitant on the provision of beading equipment.

One area in which these requirements have called for improvement is the system for handling the can bodies or body cylinders, particularly during feeding into the machine and removal therefrom. Satisfactory handling systems exist on known machines of various types, which are in general however capable of operation only at speeds in the range 450 to 800 cans per minute, and typically about 450 to 600 cans per minute. In one typical arrangement, body cylinders for three piece cans are delivered into the beading machine by a screw-type conveyor which delivers the cylinders at timed intervals to a feed turret of the machine. The latter places the body cylinders into a rotating turret, which consists of two discs spaced apart and rotatable together. Each body cylinder is supported by special support rollers between the two discs, which have holes concentric with the cylinder so that a pair of opposed, reciprocating mandrels can enter the body cylinder to support the latter internally during the beading operation. As the turret rotates with the body cylinder so supported, external beading rolls engage the outside of the latter to form the circumferential beads. During this operation the mandrels, which are carried by the turret, are rotating about their own axes.

The inherent disadvantage of this arrangement is that, because the mandrels are both reciprocable and rotating, they have to be driven by an external stationary gear through a cantilevered pinion of sufficiently wide face to accommodate the axial movement of the mandrel. Since this axial movement is, for each of the two opposed mandrels, more than half the length of the body cylinder, it will be realised that this, in practice, imposes a limit on the length of the body cylinder which can be beaded, particularly in view of the fact that, because the pinion is cantilevered, the greater the length of the pinion the greater is its liability to radial deflection. Furthermore, the mandrel housing is provided typically with dovetailed sliding guides which also, conveniently, carry cam follower rollers engaging a stationary cam to transmit to the mandrel its reciprocating movement into and out of the body cylinder held in the rotating turret. The arrangement whereby the body cylinder is held by a pair of reciprocable, rotating mandrels is inherently flexible since the mandrel bearings have to be located at a distance apart which is not able to be great enough to permit the rigidity which is desirable for accuracy of the beading operation. The need for adequate running clearances in the mandrel bearings and in the sliding guides mentioned above further contributes to the fact that the beads formed on the body cylinder tend to be of uneven depth. This is in many cases acceptable, but in order to keep the bead depth variation within acceptable limits it is necessary to limit both the body cylinder length and the speed of operation. In addition, such an arrangement could only be adapted for use with one-piece can bodies by providing a single mandrel having double the reciprocating stroke of one of the pair of mandrels used for a body cylinder (open at both ends) of the same length; the disadvantages of such an arrangement will be evident from the foregoing.

Some types of beading machine which exist or have been proposed are similar to apparatus of the kind hereinbefore specified, i.e. are rotary turret-type machines. A usual arrangement of the tooling is to provide a beading rail and beading rollers, so arranged that the workpiece is forced against the beading rail by the beading rollers, which are spring-loaded for this purpose. The beading rail is profiled so as to form the beads against either an internal mandrel or the beading rollers which in that case are arranged to be inside the hollow workpiece during the beading operation. The internal, or male, tool element, whether mandrel or rollers, will be suitably profiled. Alternatively the rail may be absent, beading being effected between external rollers and an internal mandrel.

According to the invention in a first aspect, in apparatus of the kind hereinbefore specified, each of the said holding means comprises a separate cradle having opposed end walls for accommodating a thin-walled hollow workpiece therebetween, a first of said end walls having an opening for receiving a said male tool element therethrough, and at least one of the said end walls having lateral locating means for the workpiece, the cradle being open at one side for receiving the workpiece through that side. Preferably each cradle is arranged so that its said open side faces radially outwards with respect to the turret axis.

The lateral locating means of each cradle preferably include a workpiece-engaging element resiliently biased radially outwardly for externally engaging the workpiece at the side of the workpiece remote from the open side of the cradle.

According to a preferred feature of the invention, the placing means comprises sliding members which are reciprocable in response to rotation of the turret, longitudinally of the main turret, such that each sliding member, when at any given angular displacement from the feed station, is always in the same longitudinal position with respect to the fixed frame of the apparatus, each cradle being carried by a free end of a respective one of said rams for positive reciprocating movement therewith.

The arrangement whereby each workpiece is positively located and carried in a separate reciprocable cradle, enables the workpieces to be placed positively in position for the required operation to be performed on the workpieces, to be held in the appropriate position during that operation, and to be positively removed from the tooling at the end at the operation.

The said means for carrying a male tool element will usually include a plurality of spindles each adapted to carry a mandrel, the spindles being arranged on the same pitch circle as the cradles so that each spindle is coaxial with the opening in the said first end wall of the corresponding cradle, and each spindle being rotatable in the turret about its own axis with rotation of the turret, whereby to rotate a workpiece carried by the corresponding cradle by means of a mandrel carried by the spindle. Preferably, each said spindle is rotatably mounted within a sleeve which is eccentric with respect to the spindle, and which is mounted in the turret for rotatable adjustment whereby to set the axis of the spindle in line with that of the opening in the said first end wall of the corresponding cradle.

The facility for moving the workpiece longitudinally to and from the tool elements, mentioned above, renders it unnecessary to reciprocate the mandrels. Accordingly, in the apparatus, being in the form of a beading machine for forming circumferential beads in the walls of metal can bodies, and having a plurality of mandrels each carried coaxially by, and rotatable with, a corresponding one of the abovementioned spindles, the mandrels are non-reciprocable and each mandrel is arranged so that its axis is at all times free of inclination with respect to the axis of the corresponding spindle.

The further tool element for external engagement with the can bodies, in a beading machine according to the invention, preferably consists only of a single arcuate beading rail coaxial with the turret and fixed to the fixed frame of the machine, the beading rail having a working surface on its inner circumferential side for engagement with the can bodies. The beading rail, which may advantageously be formed in three segments and may subtend an angle at the turret axis of about 150 degrees.

According to another preferred feature of the invention, the working surface of the beading rail is formed with a plurality of parallel beads each of which starts at a greater circumferential distance from the end of the beading rail nearest the feed station than the next adjacent bead, whereby formation of a plurality of circumferential beads may be commenced on a can body progressively in one direction along the can body. This arrangement enables the length of the body to be reduced progressively as a result of the formation of each bead in turn.

Apparatus according to the invention may be adapted for purposes other than as a beading machine. One similar application is the provision of a neck adjacent the end flange of a one-piece can body for a two-piece can, or a neck adjacent one or each of the end flanges of a body cylinder for a three-piece can. Such necks are usually deeper radially and greater in axial length than the beads which are provided for strengthening purposes, and the shape of the neck profile is usually critical, partly for reasons connected with the ability of the can to receive so-called can couplers whereby several cans may be coupled together in a group for transport and sale as a complete pack. The neck or necks can however be formed using a necking rail having a suitable profile, together with a corresponding profile on the mandrel. The present invention is particularly suitable for this purpose because the fixed necking rail, radially outside of the path of the can body or body cylinder, is relatively long and the mandrel, carrying the can body supported in its cradle, can be made to execute a relatively large number of revolutions about its own axis during the passage of the cradle past the necking rail. The same consideration does of course apply in the case of a beading rail, so that each bead can be formed gradually during a number of revolutions of the workpiece; this assists the achievement of uniform bead dimensions and smooth operation of the machine.

It will be understood that the number of working heads, viz. the number of mandrels and corresponding cradles, may be chosen to any desired value. In a typical beading machine according to the invention, there are eight or twelve heads. An eight-bead beading machine of this kind can be designed to operate satisfactorily at a speed such that it can handle as many as 1,200 can bodies or body cylinders per minute, whilst the equivalent figure for a twelve-head machine is 1,800 per minute. In the latter case, for example, the beading machine could receive the output from two bodymakers each operating at up to 900 per minute. Suitable arrangements for feeding the outputs from both bodymakers to the beading machine can easily be provided in known manner.

The workpiece in an apparatus according to the invention need not be a metal can body or body cylinder but may be any hollow workpiece having a thin wall, for example a filter case for automotive oil filters.

A problem arises in respect of body cylinders for three-piece cans which in general does not exist with bodies for two-piece cans. This is that when the cooperating beading tools pass over the side seam of the body cylinder, the radial distance between them is thereby forced to increase momentarily. Although it is usual, where a mandrel is employed, to make relief provisions whereby the additional material thickness may be accommodated, these provisions normally consist in the spring loading of the tool member, for example the beading roll carriage upon which beading rollers are mounted. There has to be some provision for freeing the components under overload or jam conditions by way of a predetermined degree of freedom; and the presence of a heavy spring-loaded mass results, when it is forced to move upon encountering the side seam, in a relatively slow return of that mass to its normal position, so that the beads are imperfect in the region immediately following the side seam. With increased speed of operation, it will be appreciated that this problem becomes exaggerated, and serious incidence of wear and noise will also result.

There is thus a need for an arrangement that will accommodate the side seam of a can body cylinder without these disadvantages. Accordingly, in an apparatus according to the invention for performing an operation on cylindrical workpieces, each mandrel has a circumferential surface and is coupled to the spindle by means of a coupling comprising a first coupling face associated with the mandrel or the spindle, a coupling member having a second coupling face, compression spring means mounting the coupling member on the spindle or the mandrel respectively, and a plurality of balls each engaging a pair of opposed, frusto-conical or spheroidal seats, the seats of each pair being formed one in each of the coupling faces and on a common axis parallel to the spindle axis, so that the spring means exerts an axial preload force whereby, if a radial force of sufficient magnitude is applied to the circumferential surface of the mandrel, the balls force the coupling faces apart to permit the mandrel to be displaced radially by the said applied force but only so long as the applied force is present, the arrangement being such that inclination between the axes of the mandrel and the spindle is substantially absent at all times.

The mandrel is preferably arranged in end-to-end relationship with the spindle, the spindle including a yoke at one end thereof, and the coupling including an axial thrust bearing such as to permit limited radial movement as between the mandrel and the yoke, and a pair of rings coaxial with the mandrel and the yoke and comprising a first ring having the first coupling face and a second ring constituting the said coupling member. By these arrangements it is the mandrel that is displaced when the beading rail or other external tool element encounters the side seam. Since the mandrel can be made of relatively light construction, the disadvantages discussed above are reduced or eliminated.

The coupling whereby each mandrel is mounted on its spindle in a manner permitting it to yield radially with respect thereto, whilst maintaining the mandrel and spindle axes parallel, is applicable also to other apparatus than that of the kind specified. Accordingly, the invention in a third aspect provides a mechanical assembly including a first and a second machine element and restraining means substantially preventing relative movement between said elements in one direction, the said elements being coupled together by a coupling comprising a first coupling face associated with one said element, a coupling member having a second coupling face, compression spring means mounting the coupling member on the other said element, and a plurality of balls each engaging a pair of opposed, frusto-conical or spheroidal seats, the seats of each pair being formed one in each of the coupling faces and on a common axis parallel to the said direction, so that the spring means exerts a preload force in the said direction, whereby if a force having a component of sufficient magnitude in any direction perpendicular to that direction is applied to the first only of said machine elements, the balls force the coupling faces apart to permit the first element to be displaced in the direction of the applied force relative to the second element, but only so long as the applied force is present.

An embodiment of the invention, in the form of a beading machine for forming circumferential beads on cylindrical metal can bodies or body cylinders, together with a few modifications thereof, will now be described in greater detail, by way of example only, with reference to the drawings hereof, in which:

FIG. 1 is a transverse sectional view of an unbeaded, one-piece metal body for a two-piece can;

FIGS. 2 and 3 are views corresponding to part of FIG. 1 but showing, respectively, two possible arrangements of circumferential beads formed in the sidewall of the can body;

FIG. 4 is a transverse sectional view of an unbeaded metal can body cylinder for a three-piece can;

FIG. 5 is a view corresponding to part of FIG. 4 but showing one possible arrangement of circumferential beads formed in the sidewall of the body cylinder;

FIG. 6 is a sectional view taken on the line VI—VI in FIG. 4, showing also in diagrammatic cross-section a mandrel or male tool element which is part of the beading machine shown in subsequent Figures;

FIG. 13 is a radial scrap section of a male tool element for use in forming beads in the can body shown in FIG. 3;

FIG. 14 is a projection of the working face of a beading rail for co-operating with the tool of FIG. 13;

Figure 7:
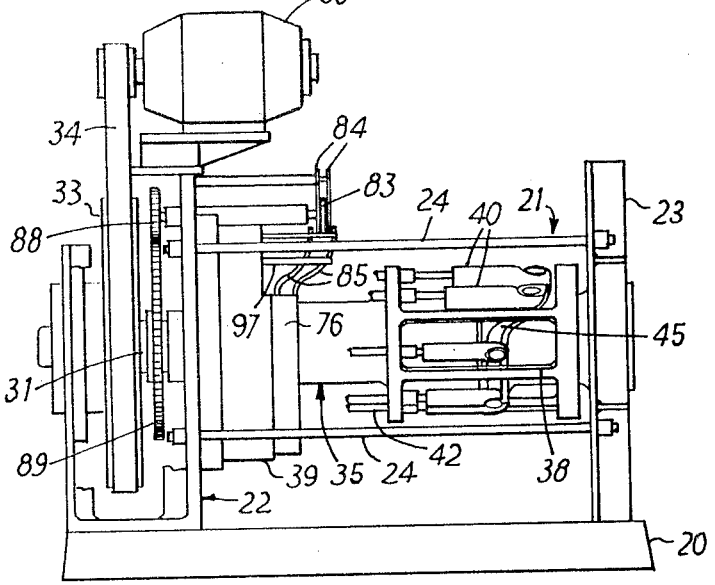
FIG. 7 is a simplified and partly cut-away; side elevation of the beading machine in a first embodiment.

Referring first to FIG. 1, this shows a one-piece metal can body having a cylindrical side wall 1 terminating in a raw edge 2 at its open end 3, and closed at its other end by an integral bottom end wall 4. FIG. 1 shows the can body as formed by deep drawing with subsequent redrawing and/or wall ironing. FIG. 2 shows the can body in a condition ready to be filled with a product and subsequently closed by securing a can end member (not shown) in known manner to an end flange 5 which is formed, together with a circumferential neck 6 merging with the flange 5, around the open end 3 after the raw edge 2 of the side wall has been trimmed, by suitable means, to the circular form indicated by chain-dotted lines in FIG. 1. FIG. 2 shows three groups of circumferential beads 7 formed in the side wall 1 for strengthening purposes. In the can body of FIG. 3 there are shown five equally spaced circumferential beads 7, the can body being without an end neck but having a so-called rolling bead 11, of the same diameter as the end seam (not shown) of the finished can. The rolling bead is formed near the bottom of the can body.

The can body cylinder 8 shown in FIGS. 4 and 6 is a conventional cylinder of the so-called "built-up" type for a three-piece metal can, and consists of a sheet of thin metal bent into the form of a cylinder having a longitudinal side seam 9 and an end flange 10 at each of its ends for attachment of can end members thereto in known manner. FIG. 5 shows the same body cylinder 8 formed with five circumferential beads 7. The description which follows is related to the operation of forming five equally-spaced circumferential beads 7 on a one-piece can body similar to that in FIG. 2 in all respects except the number and spacing of the beads 7. This can body constitutes a workpiece 12 for the beading machine.

Referring now to FIGS. 7 to 12, the beading machine illustrated therein comprises a bedplate 20 carrying a heavy, rigid, fixed machine frame 21 in the form of a main sub-frame 22 spaced apart from a further sub-frame 23 and joined to the latter by four rigid, longitudinal tie bars 24. The sub-frame 23 includes a substantial main bearing housing 25 having a cylindrical extension 26 around which is secured a fixed cam block 27. The main sub-frame 22 includes a rigid, upstanding wall 28 having a further main bearing housing 29. A constant-speed type main drive motor 30 is mounted on the wall 28. A main shaft 31 is rotatable in suitable bearings in the bearing housings 25 and 29 about its own horizontal axis 32, and carries a large-diameter belt pulley 33 which is driven through drive belts 34 directly by the drive motor 30.

Secured coaxially on the horizontal main shaft 31 is a main turret 35, which comprises essentially a sleeve portion 36 encircling the shaft and carrying a beading head 37 and a pusher frame 38. The main turret 35 is a rigid unit and is shown in simplified form in FIG. 8. The beading head 37 is of cylindrical form and is closely encircled coaxially by a rigid cylindrical shroud 39 which is part of the main sub-frame 22 and which extends axially a little way beyond the beading head 37.

Figure 12:
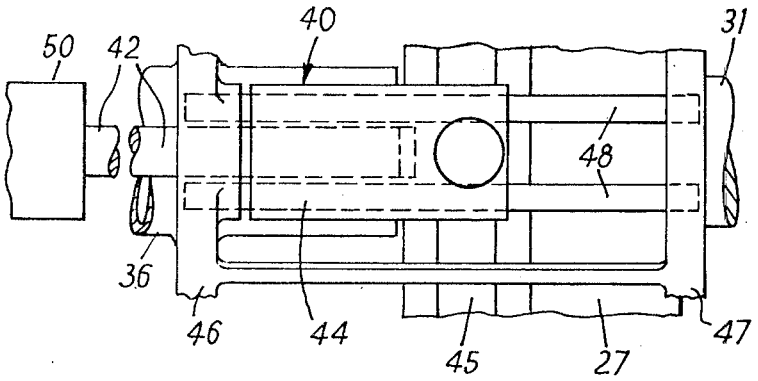
FIG. 12 is an outside view, seen radially, showing a ram associated with a said cradle.
Figure 9:
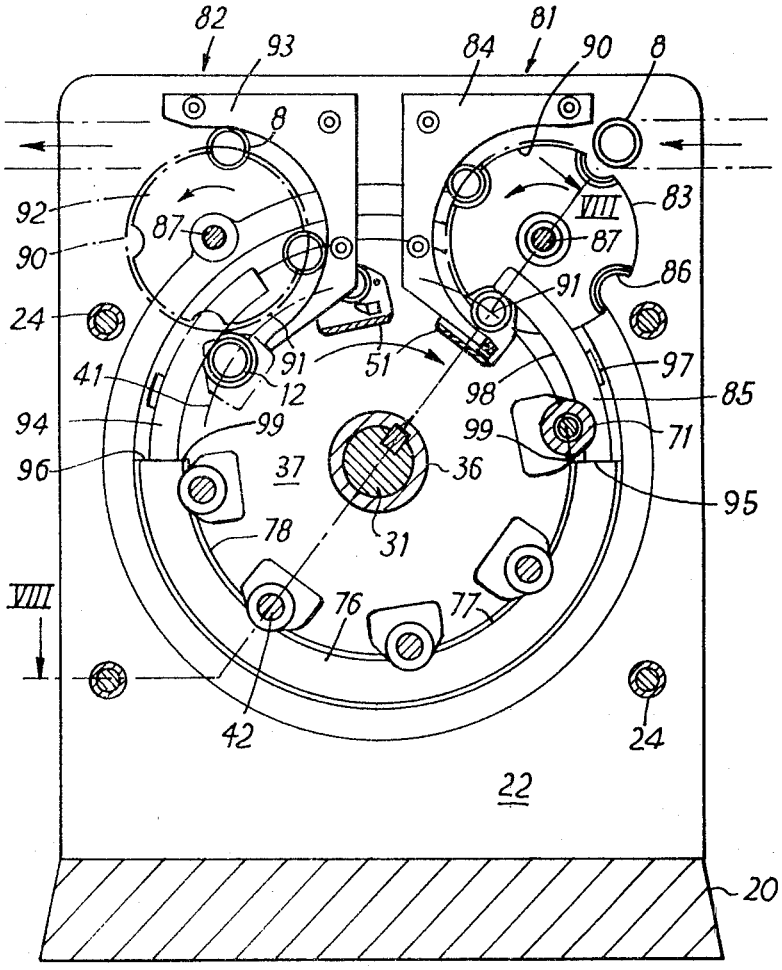
FIG. 9 is a simplified sectional and elevation, taken on the line IX—IX in FIG. 8.

The pusher frame 38 carries a plurality of placing means in the form of eight longitudinally-reciprocable pushers 40 which are arranged in equal circumferential spacing on a common pitch circle 41 (FIG. 9). Each pusher 40 comprises a ram 42 having at one end a guide block 44 which carries a pair of cam follower rollers 43. The cam follower rollers 43 engage in a fixed, backlash-free cam 45 formed in the outer cylindrical surface of the cam block 27. The pusher frame 38 of the main turret includes proximal and distal end ring portions 46,47 respectively, which are spaced apart longitudinally and between which there extend pairs of parallel guide bars 48 fixed to the end ring portions. The guide bars 48 of each pair, as is best seen in FIG. 12, are arranged to either side of a respective one of the rams 42, and extend through the guide block 44 of the latter, so that when the ram is movable by the cam 45 longitudinally, it is supported on the guide bars 48 to ensure that, throughout its travel, its axis will be maintained straight. The need for accuracy in this regard will become apparent hereinafter; the provision of the guide bars 48 and guide block 44 enables the pushers to be made of relatively light mass, which assists in the realisation of very high speeds of operation. The guide bars 48 are not shown in FIG. 7. The rams 42 in addition extend through sliding bearings 49 in the proximal end ring portion 46 of the pusher frame.

Each ram 42 has a pusher head 50 at the end thereof remote from the cam follower rollers 43. Fixed to each pusher head 50 is a respective one of a plurality of separate holding means in the form of a cradle 51. Each cradle 51 is adapted, as will be seen in greater detail hereinafter, for carrying the workpiece 12. The details of each cradle are best seen with reference to FIGS. 10 and 11. The cradle has a proximal end wall 52 which is secured to the corresponding pusher head 50, and which is joined rigidly to a distal end wall 53, opposed and parallel to the proximal end wall 52, by means of a web 55 at the radially innermost side of the cradle. The opposite side of the cradle, facing radially outwards with respect to the turret axis 32 (FIG. 8) is open as indicated at 58, so as to receive the workpiece 12 therethrough as will hereinafter be described. At least one of the end walls 52,53—and in this example each of these walls—has lateral locating means, for the can body 12. This locating means consists of a pair of diametrically-opposed lateral guide rollers 56 and a spring-mounted guide roller 57. The spring-mounted rollers 57 are arranged for external engagement with the body 12 at the side of the latter opposite the open side 58, and are biassed towards the body 12, i.e. radially outwardly. The rollers 56 are mounted on fixed pins to engage the can body sidewall across its diameter and to provide, with the roller 57, three-point support for the body 12 at the appropriate end of the latter.

The beading head 37 of the main turret has eight internal tool elements in the form of beading mandrels 59, each secured by a nut 69 around an axial extension 61 of a respective one of eight spindles 62, with which it is rotatable about its own axis with respect to the beading head 37. The spindles 62 are arranged on the same pitch circle (41, FIG. 9) as the cradles 51, and each spindle 62 is coaxial with a circular opening 54 in the distal end wall 53 of the corresponding cradle 51. The opening 54 is large enough to permit the mandrel 59 to pass through it, but not large enough for the can body 12 to pass through it.

The spindles 62 are arranged as follows. The beading head 37 has eight longitudinal holes 67 equally spaced on the pitch circle 41. In each of the holes 67 there is fitted a cylindrical sleeve 63, the bore of which is slightly eccentric with respect to the outer circumference of the sleeve. The corresponding spindle 62 is mounted, very accurately and without radial clearances, in a pair of well-spaced tapered roller bearings indicated in FIG. 8 at 64. The bearings 64 are so arranged, in known manner, as to apply a pre-loading force to the spindles 62 in order to maintain the latter precisely located. Immediately beyond the end of the sleeve 63 remote from the mandrel, each spindle carries a relatively short pinion 65. The eight pinions 65 are driven by a common ring gear 66 which is fixed to the sub-frame 22. The degree of eccentricity of each sleeve 63 is very small, but is made sufficient to enable the axis of each mandrel to be aligned accurately with that of the opening 54 in the corresponding cradle; this adjustment is achieved, when necessary, by rotating the sleeve 63 by hand in its hole 67.

The beading head 37 can be made as a sealed and oil-tight unit to reduce maintenance problems and to facilitate maintenance of the constant-temperature conditions which are particularly important at high operating speeds.

Reverting to the pusher head 50 of each ram 42 (FIG. 10), this is preferably provided with a rotatable nose such as the nose 71, for rotation with the body 12 when the latter, carried by the cradle 51, is rotated by the mandrel 59. The nose 71 is mounted in a hollow nose housing 72, in which it is urged into endwise contact with the body 12 by means of a compression spring 73. The nose housing 72 is mounted for free rotation about its own axis, by means of bearings 74 in the pusher head 50. Should the can body 12 become jammed for any reason, the spring 73 can yield to free the pusher nose 71 from the can body.

Figure 8:
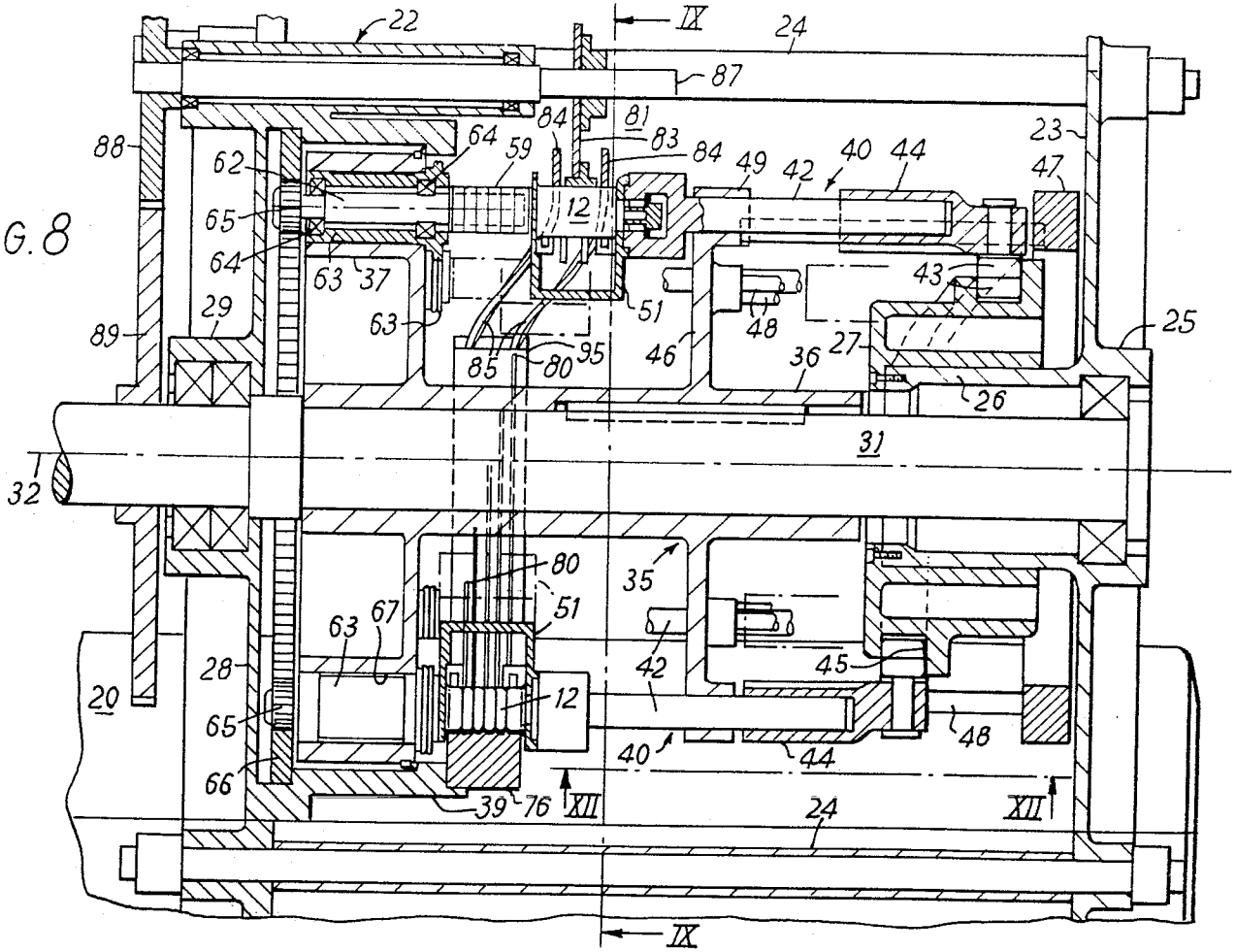
FIG. 8 is a simplified sectional side elevation, taken on the line VIII—VIII in FIG. 9 and showing the general arrangement of principal elements of the system for handling can body cylinders in the machine of FIG. 7, and for performing the beading operation.
Figure 10:
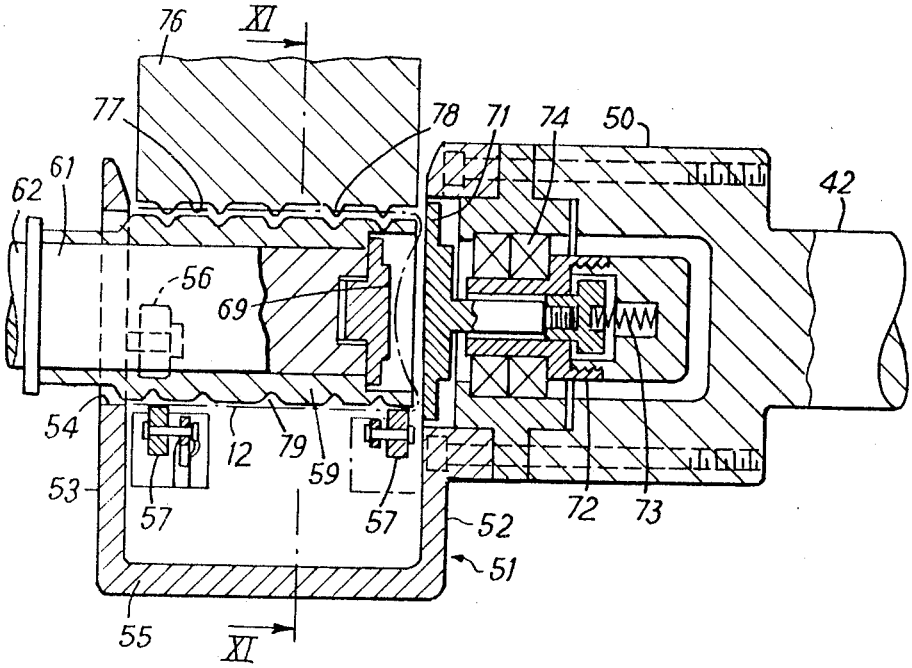
FIG. 10 is an enlarged sectional view, taken on the line X—X in FIG. 11 and showing a can body cylinder in position in a cradle of the machine during the beading operation.
Figure 11:
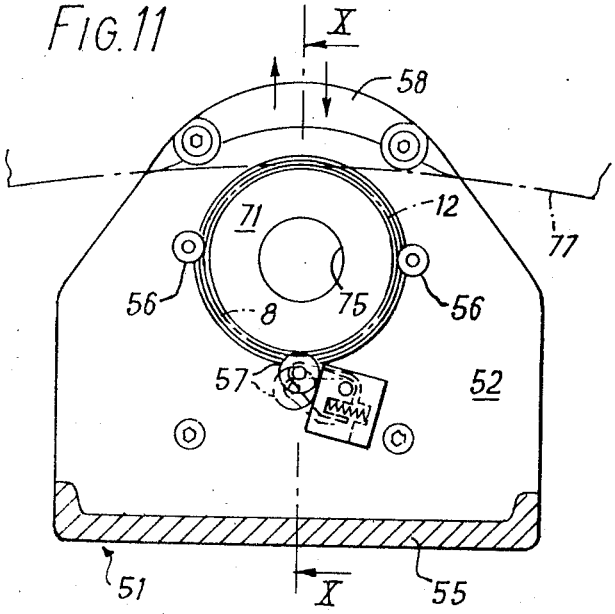
FIG. 11 is a sectional view taken on the line XI—XI in FIG. 10.

A further tool element for external engagement with the body 12 is provided in the form of a single, arcuate beading rail 76, (not shown in FIG. 11), which is formed in three segments and which is fixed, coaxially with the main turret 35, to the shroud 39 of the main sub-frame 22. The mandrel 59 and the beading rail 76 together constitute the sole tooling for forming the beads 7 (FIG. 5) on the can bodies 12, separate beading rollers being absent. The stationary beading rail 76 has on its inner circumferential side an arcuate working surface 77 provided with parallel beads 78 corresponding to the beads 7 to be formed on the bodies 12 and to complementary grooves 79 formed around the mandrel 59 (FIGS. 5, 8 and 10). Each one of the beads 78 of the rail 76 has its starting end 80 at a distance further along the rail, in the direction of rotation of the main turret 35, than the next adjacent bead, as shown in FIG. 8. This enables each bead 7 to be at least partly formed, and the consequent slight shortening of the body 12 to take place, before formation of the next bead 7 is commenced. This facility is made possible by providing a sufficiently long beading rail as mentioned above.

Referring now particularly to FIGS. 8 and 9, the machine has a feed station and a discharge station indicated at 81 and 82 respectively. The feed station 81 comprises means for feeding successive can bodies 12 to the cradles 51, whilst the discharge station 82 comprises means, spaced circumferentially as shown in FIG. 9 from the feed station, for removing the bodies 12 successively from the machine after the beading operation has been performed on each body.

The feed station 81 comprises essentially a feed turret 83, a pair of inner feed guide rails 84, and a leading end portion of a pair of outer feed guide rails 85. The discharge station 82, which in its construction is an exact "mirror image" of the feed station 81, comprises essentially a discharge turret 92, a pair of inner discharge guide rails 93, and a trailing end portion of a pair of outer discharge guide rails 94. The discharge turret 92 is not shown in detail in FIG. 9, being merely indicated by chain-dotted lines. Each of the turrets 83 and 92 has four equally-spaced, circumferential pockets 86 for engaging one can body in each pocket, and is carried by a shaft 87, parallel with the main shaft 31 and rotatable in a part of the main sub-frame 22, in synchronism with the main turret 35, by means of a gear 88 which is driven by a drive gear 89 fixed to the main shaft 31. The ratio of the gears 88 and 89, and the common diameter of the turrets 83 and 92, are so chosen that the tangential velocity of a can body undergoes no significant change during its transfer from the feed turret to the appropriate cradle 51, or from the latter to a pocket of the discharge turret. Each turret 83,92 defines a pitch circle 90 common to the can bodies 12 engaged in the pockets 86 of that turret, such that the pitch circle 41 has a common tangent with each of the pitch circles 90 at a respective transfer point indicated at 91 in FIG. 9. It will be understood that each can body 12 is thus fed into its cradle 51, and removed therefrom radially through the open side 58 of the latter, as indicated by the arrow in FIG. 11, so that, during feeding, it is guided by the rollers 56 until, at the transfer point 91, it is concentric with the hole 54 in the cradle end wall and just engaging the spring loaded roller 57.

The inner feed guide rails 84 and inner discharge guide rails 93 are mounted fixedly (by means not shown) to the main sub-frame 22, and have arcuate workpiece-engaging edges coaxial with the respective turret 83 or 92 and disposed so that there is an outward radial spacing between that edge and the turret. As is seen in FIG. 8 for the inner feed guide rails 84, the rails 84 and 93 of each pair are arranged to either side of the respective turret 83 or 92, so that each can body 12 is held by the turret pocket and the two inner rails in a stable manner as the turret rotates.

The outer feed guide rails 85 terminate, at their ends remote from the feed station, at the entry end 95 of the beading rail 76; whilst the outer discharge guide rails 94 commence at the exit end 96 of the rail 76, so that the guide rails 85, beading rail 76 and guide rails 94 together define a continuous arcuate guide for the can bodies 12 whilst the latter are held in the cradles 51, so as to keep the bodies substantially concentric with the corresponding mandrels 59 even when not actually engaged with the mandrels. As indicated at 97 diagrammatically in FIGS. 7 and 9, the outer guide rails 85 and 94 are carried fixedly by suitable members projecting from the main sub-frame 22. In end elevation, the workpiece-engaging guide faces 98 of these guide rails are arcuate and coaxial with the feed turret 35; but the path followed by the can bodies has a horizontal component both during their approach to the beading rail 76 and between the beading rail and the discharge station 82, as will shortly be explained. The rails 85,94 are therefore in a twisted form as shown in FIGS. 7 and 8, so that each can body is guided in both the longitudinal and circumferential directions, into and out of its correct disposition relative to the appropriate mandrel 59 and the beading rail 76.

The outer guide rails 85 or 94 of each pair are spaced apart by a larger distance than are the inner guide rails 84,93, so that they engage the can bodies 12 nearer to the ends of the latter. Furthermore, at both the feed and discharge stations, the inner guide rails overlap the end portions of the outer guide rails over a circumferential distance which includes the transfer point 91, i.e. they extend for a distance up to their respective free ends such that, at the point 91 and on either side thereof for a short distance, each successive can body 12 is in simultaneous engagement with both the inner and the outer guide rails. The various guide rails thus ensure that there is no possibility of the can bodies being moved out of their path by centrifugal action during their critical transfer into and out of their proper positions in the cradles 51. This is a particularly important factor in enabling very high speeds of operation to be achieved, for example 300 revolutions of the feed and discharge turrets per minute with 150 revolutions of the main turret in the same time.

In operation, the drive motor 30 rotates the main turret 35 continuously and at constant speed, the feed and discharge turrets being rotated in synchronism therewith. Can bodies 12, conveyed in timed relationship by means not shown but in known manner, are received by the feed turret 83 and transferred, as already described, to each successive cradle 51.

The fixed cam 45 is so shaped that it reciprocates the pushers 40 towards the beading head 37 during the approach phase of each revolution of the main turret in which the can bodies 12 are travelling along the fixed outer feed guide rails 85, maintains the pushers at a fixed longitudinal distance from the beading head during the whole of the beaing phase, i.e. whilst the can bodies 12 are moving past the beading rail 76, and then reciprocates them back during the retraction phase in which they travel up to the discharge station 82. During the whole of this time the bodies 12 are held positively by the spring loaded support rollers 57 of the cradles against the guide rails 85, beading rail 76 and guide rails 94 as appropriate. In this connection, reference is invited to FIG. 11. During the approach phase, the spring loaded roller 57 and outer feed guide rails 85 keep the axis of the body 12 exactly in line with that of the mandrel, i.e. in the position shown in full lines in FIG. 11. Thus, during this phase, each pusher 40 in succession places the body 12, held in the corresponding cradle 51, around the appropriate mandrel 59, the latter passing through the opening 54 in the cradle. By the time the cradle has reached the end of the guide rails 85, the pusher nose 71 is fully home with respect to the mandrel, and reciprocating movement of the pusher has ceased. At this point the body 12 is still exactly concentric (coaxial) with the mandrel. However, there is a small step, as indicated at 99 in FIG. 9, at the start of the beading rail 65, which forces the body 12 into the slightly eccentric relationship with respect to the mandrel indicated by a chain-dotted circle in FIG. 11. An outward radial force is thus applied by the spring loaded rollers 57 which urges the body 12 positively against the working surface 77 of the beading rail 76. At the same time the body 12 is forced against the outer circumferential working surface of the mandrel 59. Since the latter is in continuous rotation, the body 12 is thus forced to rotate with the mandrel 59 about its own axis, being permitted to do so by the freely rotating guide rollers 56,57.

In FIG. 10, the radial spacing between the surface 77 and the mandrel 59 is shown exaggerated for clarity, but in practice the radius of the surface 77 is of course such that this spacing is equal to the thickness of the can body side wall 1. It will of course be understood that the outer diameter of the mandrel 59 is smaller than the internal diameter of the body side wall 1 (though not necessarily smaller than that of the beads 7) to enable the latter to be stripped from the mandrel 59 having regard to the degree of flexing possible in the can body during stripping. The mandrel may in any case be of substantially smaller diameter than the body side wall, as will be seen with reference to FIGS. 15 and 16.

Continued rotation of the main turret 35 in the beading phase causes the beads 7 to be formed successively, as already described, in the body 12 by the beads 78 of the beading rail co-operating with the mandrel grooves 79. At the end of the beading phase the body 12 passes over the step 99 at the exit end of the beading rail and is thus restored by the spring loaded rollers 57 to its position concentric with the mandrel. It remains in this condition during the retraction phase, whilst the pushers retract the body 12, stripping it off the mandrel 59. The end wall 53 of the cradle acts as a positive stripping ring, to force the body 12 along the mandrel 59; it is free of the latter by the time it reaches the discharge station 82, where it is removed by the discharge turret 92 from the cradle (in the manner already described) and transferred to suitable conveyor means not shown.

An important modification applies if the can body is to be given a rolling bead 11, for example as in FIG. 3, the internal mandrel 259 for which may be as shown in FIG. 13. The mandrel 259 is similar to the mandrel 59, but with the addition of a circumferential bead 70. This co-operates with a groove 68 (FIG. 14) formed in the modified beading rail 265 which may be used for this purpose in place of the rail 65. The groove 68 extends from the end 95 of the beading rail nearest the feed station, and terminates before commencement of the beads 78, the function of which is as already described for the rail 65. Thus, in operation, the unbeaded can body is introduced in its cradle 51 (as already described herein) on to the mandrel 259, and the rolling bead 11 is formed before the adjacent bead 7 and, in succession along the can body as before, the other beads 7. It should be noted that the guide rollers 56,57 of each cradle 51 is so spaced from the adjacent end wall of the cradle as not to interfere with the bead 11, and may be profiled as indicated in FIG. 3. It should also be noted that, although the mandrel bead 70 is of similar diameter to the body sidewall 1, and may even be greater, the side wall, being very thin and therefore flexible, can be forced over this bead, both during placing on the mandrel 259 and during stripping therefrom, without damage.

It will be understood that, by providing beads on the mandrel 59 or 259 in place of the grooves 79, and grooves on the beading rail 65 or 265 in place of the beads 78, outwardly-projecting beads may be formed on a can body cylinder or can body instead of the inwardly-projecting beads 7 (FIGS. 2, 3 and 5).

One-piece can bodies may be beaded in the machine before or after the flange 5 is formed, or even before the can body is trimmed. Alternatively trimming and/or flanging may be performed in the beading machine, for which purpose the profile of the working surface 77 of the beading rail will be suitably modified. For trimming, a fixed knife edge may be incorporated in the surface 77, in the same manner as the beads 78; or alternatively a separate, rotating, trimming knife may be mounted on the beading head 37 in an appropriate position, being moved into engagement with the can body through an open side of the cradle 51 by operation of a fixed cam in known manner. The beads 78 may be absent, the machine being used only for trimming. However, if trimming takes place the can body must be suitably located axially, and for this purpose the spring-loaded pusher nose 71 and the free end of the mandrel are suitably profiled so as to locate the bottom end 4 of the can body positively between them in the cradle when the can body is on the mandrel. The guide rollers 56 and 57 are suitably spaced from their associated cradle end walls 52,53 to ensure that the can body remains properly located in the cradle even after trimming, until it is removed at the discharge station. A second discharge turret may be provided for removal of the trimmed-off portion of the can body.

Similarly, by provision of a suitable profile on the rail 65, the end flange 5 may be formed on a trimmed can body, as may a neck 6 (FIG. 2) in the same manner as the beads 7. The number of beads 7 may be chosen at will, as may their grouping.

Comb-like scrapers (or other suitable devices) may conveniently be provided on the beading head, to keep the working surface 77 of the beading rail clean. Such scrapers may be associated with, or replaced by, brushes. These devices may readily be placed between one mandrel and the next.

An important feature of the machine is the fact that the mandrels are non-reciprocating, relative movement as between the mandrels and the can bodies being effected entirely by movement of the latter.

Figure 15:
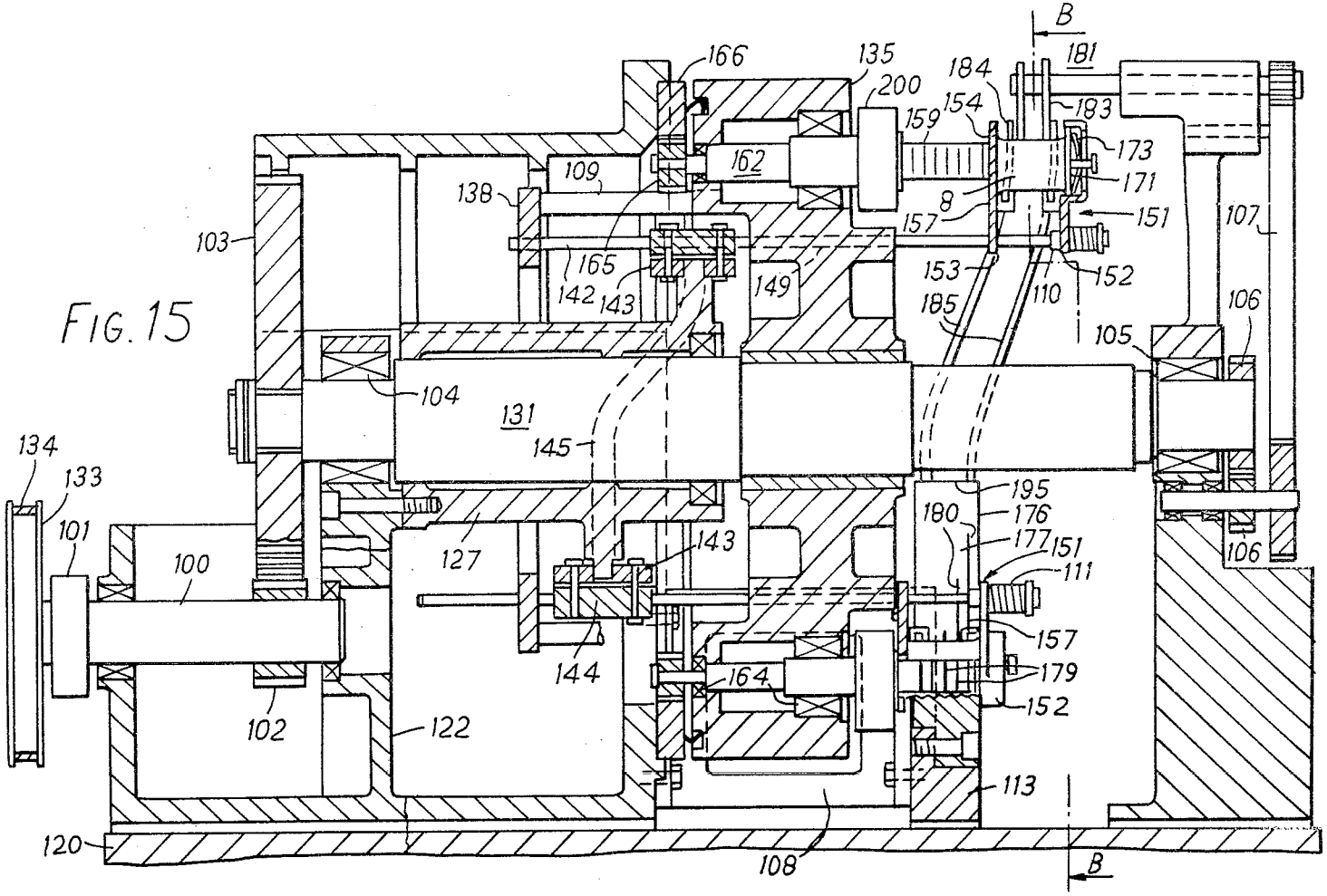
FIG. 15 is a simplified sectional side elevation, taken on the line A—A in FIG. 16 and showing the general arrangement of principal elements of the machine in a preferred embodiment.
Figure 16:
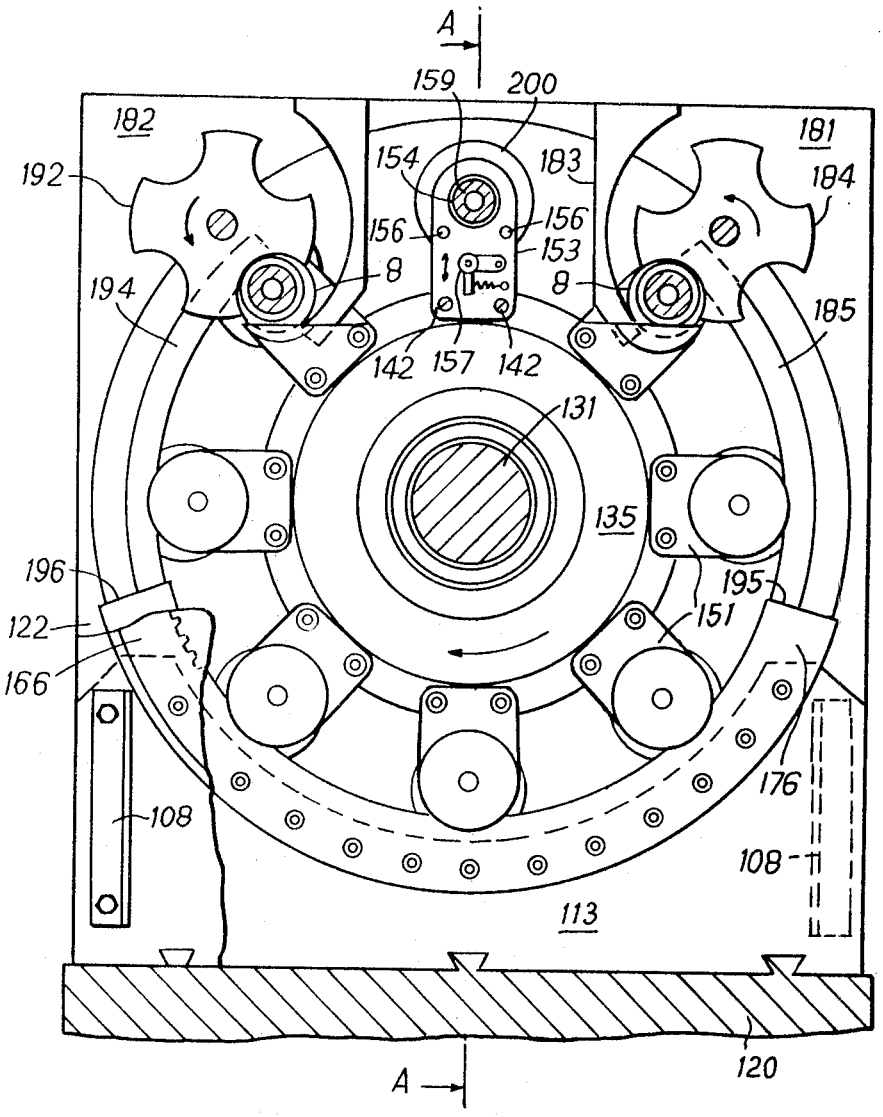
FIG. 16 is a simplified sectional end elevation, taken on the line B—B in FIG. 15.

Referring now to FIGS. 15 and 16, the beading machine shown therein functions on the same principles as that shown in FIGS. 7 to 12, but the machine layout is different. In particular, the parts of the machine for effecting reciprocating movement of the cradles are simpler, and the zone through which the can bodies move is near to one end of the machine, so that accessibility to all parts of this zone is facilitated. For ease of reference, parts having the same function as equivalent parts of the machine shown in FIGS. 7 to 12 are identified by reference numerals in the range 120 to 199 inclusive, in which 100 is added to the reference numeral used in FIGS. 7 to 12, so that, for example, the fixed cam 145 is equivalent to the fixed cam 45 in function.

The machine shown in FIGS. 15 and 16 has a bedplate 120 carrying a main sub-frame 122, a beading rail cradle 113, an end sub-frame 123, and a main drive motor not shown. The motor drives, through a main drive belt 134, a belt pulley 133 fixed to a layshaft 100 which is rotatable in the main sub-frame 122. The layshaft 100 carries a brake 101 and a pinion 102 which engages a main drive gear 103 fixed to one end of a main shaft 131. The latter is carried by main bearings 104,105 in the main and end sub-frames 120 and 123 respectively; and its other end drives, through gears 106 and a belt drive 107, a feed turret 184 and a discharge turret 192 which are located at a feed station 181 and a discharge station 182 respectively. The turrets 184,192 are mounted on the end sub-frame 123.

The cradle 113 carries an arcuate fixed beading rail 176, which has an internal working surface 177 having equally-spaced annular beads 178. In this example, the rail 176 subtends an angle of 150 degrees, so that the can bodies during the beading operation are subjected to as many revolutions as possible about their own axes. To ensure accurate concentricity between the beading rail 176 and main shaft 131, the cradle 113 is rigidly joined to the main sub-frame 122 by a pair of parallel, vertical stiffening plates 108.

The main shaft 131 carries a turret 135 in which in this example, eight equally-spaced mandrel spindles 162 are rotatably mounted on a common pitch circle by bearings 164. Each spindle 162 carries a pinion 165, and all of the pinions 165 engage a ring gear 166 fixed to the main subframe 122 coaxially with the turret 135, so that when the latter rotates, all the mandrel spindles 162 are rotated about their own axes at a common speed. Each spindle 162 carries a coupling 200 to which is secured a respective one of eight beading mandrels 159, concentric with its associates spindle 162.

The couplings 200 will be described below with reference to FIGS. 17 to 19 and are adapted to allow the mandrels to yield radially by a limited amount so as to compensate for the increased thickness of the workpiece wall represented by a side seam such as the seam 9 (FIG. 4). This yielding facility is not essential if one-piece can bodies (such as shown in FIGS. 1 to 3) are to be beaded, but, if it is provided, the machine may be used with such bodies and with body cylinders 8 of the kind shown in FIG. 4. If the yielding facility is not required, the coupling 200 is omitted and the mandrel is secured directly on to the spindle 162, the latter being modified to be of the correct length for this purpose.

By way of example, this description with reference to FIGS. 15 and 16 relates to the beading of body cylinders 8, open at both ends and having a side seam 9, the cylinders 8 in this example being of substantially larger diameter than the mandrels 159.

Eight pairs of parallel, longitudinal sliding bearings 149 are provided in the turret 135 on a common pitch circle, each pair carrying a pair of parallel push rods 142 which are slidable in the bearings 149 and in a common push-rod guide ring 138, the ring 138 being fixedly mounted on rigid arms 109 extending from the side of the turret opposite the side where the mandrels 159 are. On the same side of the turret, each pair of push rods 142 is fixed to a guide block 144 carrying a pair of cam follower rollers 143 which engage between them a fixed cam 145 carried by a fixed, rigid cam sleeve 127. The latter (with the cam 145) is fixed to the sub-frame 122 coaxially around the main shaft. Thus rotation of the turret causes the pairs of push rods to be moved longitudinally according to the profile of the cam 145.

Each pair of push rods 142 carries at the same side of the turret 135 as the mandrels 159, a cradle 151 comprising a pair of parallel, longitudinally spaced-apart plates 152,153. The plate 152 nearest the end of the push rods is mounted thereon against locating stops 110 by springs 111, whilst the plate 153 is rigidly fixed to its pair of push rods.

The plate 153 has a hole 154 large enough to admit the mandrel 159 therethrough. The plate 152 carries a pressure plate 171 biased by a spring 173 towards the mandrel; this is for holding the body cylinder 8 firmly in place against the other plate 153.

In operation, with the turret 135 being rotated at constant speed by the drive motor, and with the mandrels 159 consequently rotating about their axes and the feed and discharge turrets 189,192 also rotating, body cylinders 8 are fed by conventional means, not shown, to the feed turret, 184, which transfers each cylinder in succession to an empty one of the cradles 151. During this transfer, the cylinder 8 is guided (radially inwardly with respect to the axis of the main shaft 131) into the cradle 151 by the turret 184 and a fixed, arcuate inner feed guide 183, until the cylinder sidewall engages, at each of its ends, a spring-loaded support roller 157 carried by the respective cradle plate 152,153 (FIG. 16). As it enters the cradle the body cylinder passes at each end between two lateral guide rollers 156, also carried by the respective cradle plate. These rollers 156 prevent movement of the body cylinder, with respect to the cradle, in the direction mutually perpendicular to the body cylinder axis and the radius of the main turret.

With continued rotation of the turret 135, the body cylinder is located and guided by a fixed, arcuate outer feed guide rail 185 and resiliently supported by the support rollers 157. The rail 185 is a concentric extension of the beading rail 176. During its travel along the rail 185, the radial position of the body cylinder is such that the cylinder encircles the hole 154 in the plate 153.

Thus, as the body cylinder is now carried by the cradle along the outer feed guide rails 185, the cradle is moved, by virtue of the shape of the fixed cam 145 as seen in FIG. 15, towards the adjacent mandrel 159 so that the body cylinder is thereby placed around the mandrel (though not coaxially therewith). The rails 185, FIG. 15, are shaped correspondingly to the cam 145 so as continuously to support the body cylinder. When the cradle reaches the entry end 195 of the beading rail 176, a slight step 199 (FIG. 16) forces the body cylinder against the mandrel 159 so that it is frictionally held between the latter and the beading rails. As the turret 135 continues to rotate, therefore, the body cylinder is thereby rotated between the mandrel and the beading rail. To this end the pressure plate 171 of the cradle, engaging one end of the body cylinder, is preferably freely rotatable in the cradle plate 152; and a suitable ring (not shown) of the same diameter as the body cylinder, may if desired be mounted for free rotation in the plate 153 in engagement with the other end of the cylinder.

As the body cylinder travels along the beading rail, the beads 7 are formed in it by the beads 178 of the latter co-operating with corresponding circumferential grooves 179 of the mandrel. When the cradle reaches the exit end 196 of the beading rail, the body cylinder is forced from its close engagement with the mandrel by the support roller 157, and is then carried along an outer discharge guide rail 194 until it is transferred at the discharge station 182 from the cradle 151 to the discharge turret 192, in a manner which is exactly the reverse of that by which it was fed into the cradle at the feed station 181. The body cylinders are removed from the turret 192 by conventional means, not shown.

Figure 17:
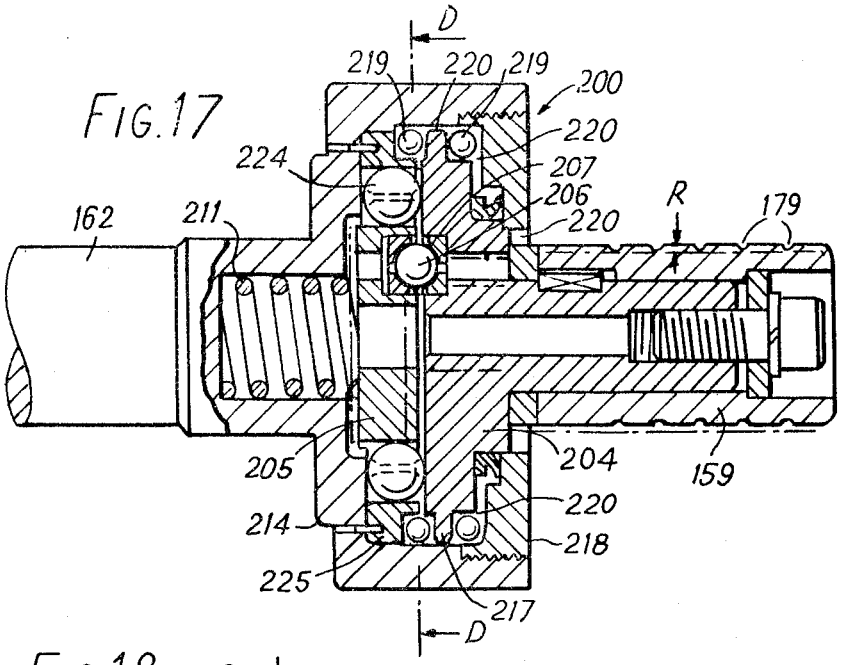
FIG. 17 is a sectional side elevation of a beading mandrel and its mounting, in one embodiment, taken on the line C—C in FIG. 18.
Figure 18:
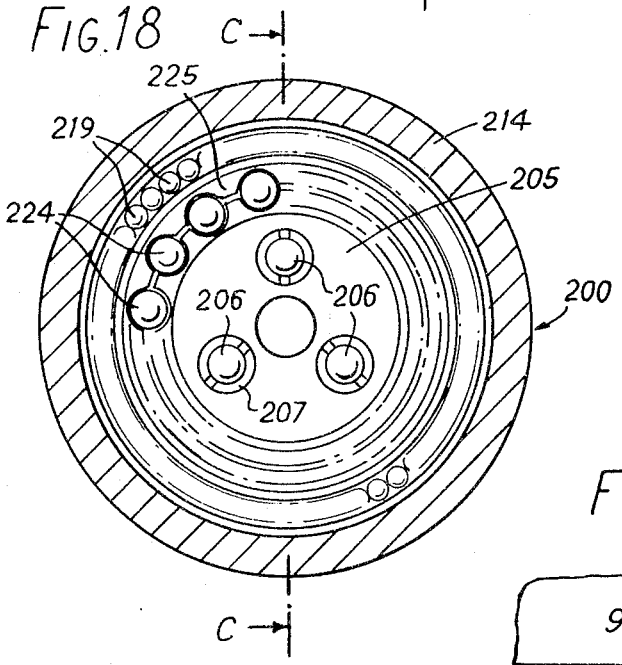
FIG. 18 is a sectional end elevation taken on the line D—D in FIG. 17.
Figure 19:
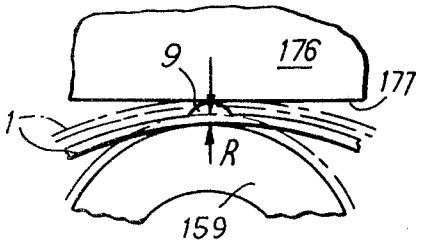
FIG. 19 is a diagrammatic end view illustrating the behaviour of the mandrel shown in FIGS. 17 and 18 when the machine is performing a beading operation over a longitudinal side seam of a can body cylinder.

Referring now to FIGS. 17 to 19, the construction of the coupling 200, whereby the mandrel 159 is enabled to yield momentarily, parallel to its own axis, in order to allow for the increased thickness of the sidewall 1 of a built-up body cylinder due to the side seam 9, is here shown in detail. FIG. 19 shows this yielding diagrammatically, the normal position of the side wall 1 and of the mandrel 159, in relation to the working surface 177 of the beading rail 176, being indicated by phantom lines. Their position, after yielding through a radial distance R when the side seam 9 comes between the bearing rail and the mandrel, is indicated by full lines in FIG. 19.

A first machine element (viz. the mandrel 159) is arranged in end-to-end relationship with the mandrel spindle 162. The spindle has at its outer end a second machine element, viz. a yoke 214, upon which the mandrel is mounted as follows. The mandrel 159 is secured coaxially to a mounting member 204 having an integral, circumferential, double-sided thrust ring 217 which bears, through two races of balls 219, upon, respectively, an outer ring 225 secured in the yoke 214, and a clamping nut 218 which is secured in the outer end of the yoke. The nut 218 may be adjusted to set the desired value of the necessary axial pre-load force for the thrust bearing provided by the rollers 219 and ring 217. The outer ring 225 is coupled, for simultaneous rotation, with a circular support block 205, which is, however, movable axially with respect to the ring 225 and mounting member 204, against a compression spring 211 mounted in the spindle 162. This coupling is obtained by a race of balls 224, each engaged in a pair of semicylindrical pockets in the ring 225 and block 205 respectively.

Three support balls 206 are equally spaced, on a common pitch circle, in respective spheroidal seatings 207 in the opposed faces of the mounting member 204 and support block 205. It will be noted that there are radial clearances 220 around the thrust ring 217 and balls 219, and between the clamping nut 218 and the assembly of mandrel 159 and mounting member 204. This latter assembly can thus move in any radial direction through the distance R with respect to the spindle 162 when a force having a radial component of sufficient magnitude in that direction is applied to the mandrel 159 at its outer circumferential surface. When such a force is applied, for example by the introduction of the body cylinder side seam 9 between the mandrel and the beading rail, the support balls 206 transmit this force to the support block 205. This tends to overcome the axial pre-load force exerted on the latter by spring 211, so that the support block is moved back (as indicated by phantom lines in FIG. 17), thus leaving the mounting member 204 and mandrel 159 free to yield radially under the applied radial force. As soon as this force is removed, spring 211 restores the mandrel to its normal condition coaxial with the spindle 162. It will be appreciated that the thrust bearing 217, 219 ensures that the yielding movement of the mandrel will always be parallel with the mandrel axis.

Figure 20:
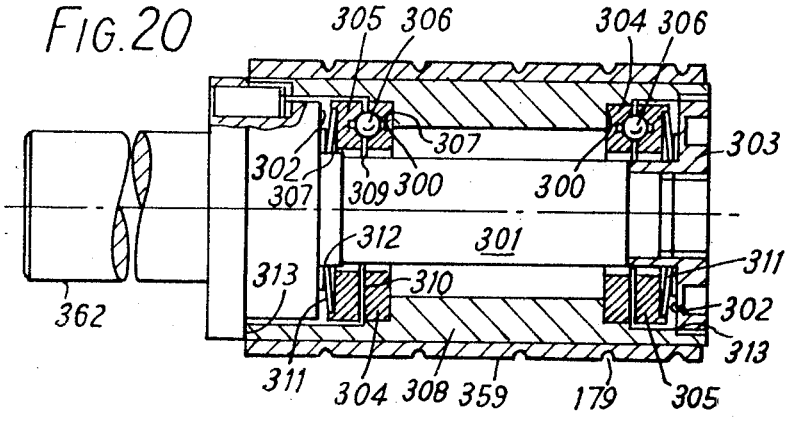
FIG. 20 is a sectional side elevation of a beading mandrel and its mounting, in another embodiment.
Figure 21:
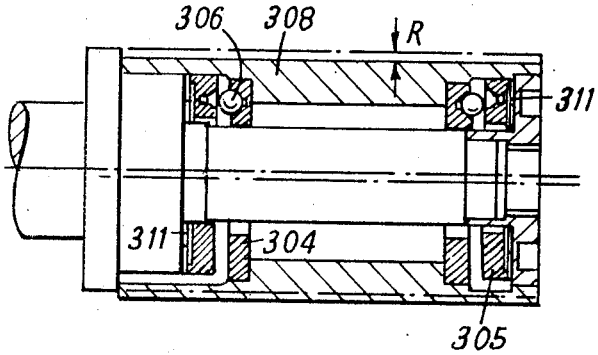
FIG. 21 is a view similar to FIG. 20, illustrating the behaviour of the mandrel when the machine is performing a beading operation over a longitudinal side seam of a can body cylinder.

Referring now to FIGS. 20 and 21, in this alternative embodiment the mandrel is in the form of a cylindrical sleeve 359. The mandrel spindle, 362, has an extension or core constituting a second element of the assembly, upon which the mandrel is mounted and to which it is mechanically coupled by means of a coupling. The core consists of an integral, axial extension portion 301 of the spindle, encircled by a sleeve 308, and a nut 303 secured to the free end of the extension portion 301. The coupling comprises two pairs of steel rings 304, 305, each having between them three support balls 306, and compression spring means in the form of a Belleville washer 311. Each of the rings 305 constitutes a coupling member and has a flanged rear face 312, and each Belleville washer 311 bears between a respective one of the faces 312 and an annular surface 302. There are two annular surfaces 302, spaced apart axially and formed, respectively, on the spindle extension portion 301 and on the nut 303, so that the Belleville washers 311 are in opposition to each other. The surfaces 302 face each other. Each of the rings 304 has a rear face, abutting a complementary annular face 300 in which a short end recess of the sleeve 308 terminates, and a first coupling face in the form of a front face 309 of the ring 304. A second coupling face in the form of a front face 310 of the ring 305, lies closely opposed to the face 309. Each of the balls 306 engages in a pair of spheroidal seats 307, the seats of each pair being formed one in each of the co-operating coupling faces 309, 310 respectively. The common axis of the seats 307 constituting each pair of seats is parallel to the spindle axis.

The sleeve 308 is restrained from moving axially relative to the spindle by shoulders 313 on the spindle extension portion 301 and nut 303; but if a force having a component of sufficient magnitude in any radial direction is applied to the mandrel 359 only (i.e. not to the spindle 362 as well) at its outer circumferential surface, the axial pre-load force imposed on the sleeve 308 by the Belleville washers 311 is overcome by a tendency of the balls 306 to roll radially in the direction of the applied force, the latter being transmitted to the balls by the rings 304. The effect of this is that the balls, as shown in FIG. 21, tend to move out of the seats 307 in the face 310 of the spring loaded ring 305, thus forcing the surfaces 309, 310 apart and compressing the Belleville washers 311. The mandrel 359 thus moves radially through a distance R in the direction of the applied force. However, because of the action of the washers 311 and the shape of the frustoconical seats 307, as soon as the applied radial force is removed the coupling will automatically be restored to its normal position as shown in FIG. 20.

It will be appreciated that the axis of the mandrel 359 and sleeve 308 remains at all times, as shown in FIGS. 20 and 21, coincident with or parallel to that of the spindle 362, i.e. no inclination occurs between these two axes. This effect is assisted if the end of the mandrel assembly is radially supported by the pressure plate 171 (FIG. 15). For this purpose the nut 303 may be provided with an axial projection to engage in a suitable socket formed in the pressure plate.

In the arrangement described with reference to FIGS. 20 and 21, it will be appreciated that the Belleville washers or other spring means may be placed between the coupling member and the mandrel-holding sleeve 308 instead of between the coupling member and the spindle. It will also be appreciated that mechanical assembles including couplings such as those described may be used in any application in which a sensitive device is needed for moving a machine element with respect to another machine element in a manner such that the orientation of the one element relative to the other remains the same and so that the movement is quickly reversed when the applied force giving rise to that movement is removed.

Because the mandrel has very little mass, in both of the embodiments above described, both the yielding and the return movements are virtually instantaneous, so that the beads 7 being formed in the body cylinder are continuous, there being little or no "jump-over" of the familiar kind which if present would be characterised by an interruption in the beads 7.

Many variations are possible in the form which may be taken by the radially-yieldable mandrel, the essential requisites being, firstly, that the mass to be moved shall be of sufficiently small value for "jump-over" to be avoided; and, secondly, that the mandrel and spindle axes shall always be coincident or parallel.

It will be appreciated that any reasonable number of mandrels desired, and a corresponding number of cradles, may be provided. For example, in the embodiment of the machine shown in FIGS. 15 and 16, the said number may be 12 instead of 8.

We claim:

1. Apparatus for performing an operation on a succession of thin-walled hollow workpieces, comprising a fixed machine frame; a main turret rotatable about its own axis in said frame; a plurality of holding means carried by the main turret and spaced apart on a common pitch circle for holding a plurality of said workpieces; a feed station for feeding successive workpieces to the holding means; a discharge station, spaced circumferentially from the feed station with respect to the main turret axis for removing successive workpieces from the holding means; means on the main turret for carrying a male tool element for engagement within a said workpiece; means for carrying a further tool element for external engagement with a said workpiece in co-operation with the main tool element whereby to perform said operation on each workpiece in succession whilst the workpiece is held by the holding means between the feed station and the discharge station; and the apparatus further comprising placing means carried by the main turret, for effecting relative movement, longitudinally of the main turret and in synchronism with rotation thereof, as between each holding means in succession and said male tool element, so as to put each workpiece and the tool elements into, and to take them out of, their relative dispositions for said operation, characterised in that each of said holding means comprises a separate cradle having opposed end walls for acommodating a thin-walled hollow workpiece therebetween, a first of said end walls having an opening for receiving a said male tool element therethrough, and at least one of said end walls having lateral locating means for the workpiece, the cradle being open at one side for receiving the workpiece through that side.

2. Apparatus according to claim 1, characterised in that the lateral locating means of each cradle include a workpiece-engaging element resiliently biassed radially outwardly for extending engaging the workpiece at the side of the workpiece remote from the open side of the cradle.

3. Apparatus according to claim 1 or claim 2, characterised in that the placing means comprises a plurality of sliding members and actuating means thereof, responsive to rotation of the main turret, for reciprocating each sliding member longitudinally of the main turret such that each sliding member, when at any given angular displacement from the feed station, is always in the same longitudinal position with respect to the fixed frame of the apparatus, each cradle being carried by a respective one of said sliding members for positive reciprocating movement therewith.

4. Apparatus according to claim 1 or claim 2, characterised in that the male tool elements are mandrels, the said means for carrying a male tool element comprising a corresponding number of spindles each adapted to carry a said mandrel, the spindles being arranged on a pitch circle such that each spindle is coaxial with the opening in the said first end wall of the corresponding cradle, and each spindle being rotatable in the main turret about its own axis with rotation of the main turret, whereby a workpiece carried by the corresponding cradle is rotatable by means of the respective mandrel carried by the spindle.

5. Apparatus according to claim 4, characterised in that each said spindle is rotatably mounted within a sleeve which is eccentric with respect to the spindle, and which is mounted in the main turret for rotatable adjustment whereby to set the axis of the spindle in line with that of the opening in the said first end wall of the corresponding cradle.

6. Apparatus according to claim 1, characterised in that the feed station and the discharge station comprises a feed turret and a discharge turret, respectively, said feed turret and said discharge turret each having workpiece-engaging pockets equally spaced about its circumference and the feed turret being rotatable in the fixed frame of the apparatus, about its own axis parallel with the main turret axis, in synchronism with the rotation of the main turret, each of the feed and discharge turrets defining a respective common pitch circle of workpieces engaging in said pockets thereof such that this pitch circle defines a common tangent with the pitch circle of the cradles, whereby each cradle in succession can receive from a respective pocket of the feed turret a workpiece fed radially thereby into the cradle through the open side of the cradle, and each pocket of the discharge turret in succession can receive from a respective said cradle a workpiece removed radially from the cradle through the open side of the cradle.

7. Apparatus according to claim 6, characterised in that each of the feed and discharge stations includes a pair of inner guide rails carried fixedly by the fixed frame of the apparatus, the inner guide rails having arcuate workpiece-engaging edges coaxial with the corresponding feed or discharge turret, but being radially outward of the latter and to either side thereof, for so engaging a portion of each workpiece as to hold the latter in a respective pocket of the said feed or discharge turret.

8. Apparatus according to claim 6 or claim 7, characterised by a pair of outer feed guide rails and a pair of outer discharge guide rails, carried fixedly by the fixed frame of the apparatus and having arcuate workpiece-engaging edges coaxial with the feed turret and discharge turret respectively, for engagement with each workpiece held in a respective said cradle in a portion of the workpiece radially outward with respect to the main turret axis, each said pair of outer guide rails being so shaped as to support the workpiece radially during said relative movement effected by the placing means to put the workpiece and the tool elements into their relative dispositions respectively for and after said operation.

9. Apparatus according to claim 4, in the form of a beading machine for forming circumferential beads in the walls of metal can bodies, characterised in that the mandrels are non-reciprocable and each mandrel is arranged so that its axis is at all times free of inclination with respect to the axis of the corresponding spindle.

10. A beading machine according to claim 9, characterised in that the further tool element for external engagement with the can bodies consists only of a single arcuate beading rail coaxial with the main turret and fixed to the fixed frame of the machine, the beading rail having a working surface on its inner circumferential side for engagement with the can bodies.

11. A beading machine according to claim 10, characterised in that the working surface of the beading rail is formed with a plurality of parallel bead-forming elements each of which starts at a greater circumferential distance from the end of the beading rail nearest the feed station than the next adjacent bead, whereby formation of a plurality of circumferential beads may be commenced on a can body progressively in one direction along the can body.

12. Apparatus according to claim 5, for performing a said operation on cylindrical workpieces, characterised in that each mandrel has a circumferential surface and is coupled to the spindle by means of a coupling comprising a first coupling face associated with the mandrel or the spindle, a coupling member having a second coupling face, compression spring means mounting the coupling member on the spindle or the mandrel respectively, and three equally-spaced support balls each engaging a pair of opposed seats, the seats of each pair being formed one in each of the coupling faces and on a common axis parallel to the spindle axis, so that the spring means exerts an axial preload force whereby, if a radial force of sufficient magnitude is applied to the circumferential surface of the mandrel, the support balls force the coupling force apart to permit the mandrel to be displaced radially by the said applied force but only so long as the applied force is present, the arrangement being such that inclination between the axes of the mandrel and the spindle is substantially absent at all times.

13. Apparatus according to claim 12, characterised in that the mandrel is arranged in end-to-end relationship with the spindle, the spindle including a yoke at one end thereof, and the coupling including an axial thrust bearing such as to permit limited radial movement as between the mandrel and the yoke, and a pair of rings coaxial with the mandrel and the yoke and comprising a first ring having the first coupling face and a second ring constituting the said coupling member.

14. Apparatus according to claim 12, characterised in that the mandrel is in the form of a sleeve coupled by said coupling to an axial extension of the spindle and encircled by the sleeve, the axial extension having a pair of annular surfaces spaced apart axially and facing each other, and the said coupling comprising two pairs of rings, each pair comprising a first ring having a said first coupling face and a second ring constituting a coupling member, each of the two second rings being mounted by a separate compression spring means and the two spring means being arranged in opposition to each other to engage the respective annular surfaces.

15. Apparatus according to claim 12, characterised in that the said seats for the support balls are spheroidal.

* * * * *

UNITED STATES PATENT AND TRADEMARK OFFICE

CERTIFICATE OF CORRECTION

PATENT NO. : 4,246,770

DATED : January 27, 1981

INVENTOR(S) : Jozef T. Franek et al

It is certified that error appears in the above-identified patent and that said Letters Patent are hereby corrected as shown below:

---[30] Foreign Application Priority Data

June 13, 1978 Great Britain.....26778/78---

Signed and Sealed this

*Fourteenth* Day of *April 1981*

[SEAL]

*Attest:*

RENE D. TEGTMEYER

*Attesting Officer* *Acting Commissioner of Patents and Trademarks*